US011103740B2

(12) United States Patent
Boyles et al.

(10) Patent No.: US 11,103,740 B2
(45) Date of Patent: Aug. 31, 2021

(54) FOOT SUPPORTS WITH FIT ENHANCEMENT FEATURES FOR AN EXERCISE MACHINE

(71) Applicant: NAUTILUS, INC., Vancouver, WA (US)

(72) Inventors: Daniel C. Boyles, St. Louis Park, MN (US); Mark R. Nestande, Victoria, MN (US); Jeffrey A. Gettle, Portland, OR (US); Joshua S. Parah, Woodbury, MN (US); Robert A. Hagen, Brooklyn Park, MN (US)

(73) Assignee: Nautilus, Inc., Vancouver, WA (US)

( * ) Notice: Subject to any disclaimer, the term of this patent is extended or adjusted under 35 U.S.C. 154(b) by 39 days.

(21) Appl. No.: 16/297,310

(22) Filed: Mar. 8, 2019

(65) Prior Publication Data

US 2020/0282256 A1 Sep. 10, 2020

(51) Int. Cl.
*A63B 21/00* (2006.01)
*A63B 22/00* (2006.01)
(Continued)

(52) U.S. Cl.
CPC ..... *A63B 21/4034* (2015.10); *A63B 21/4035* (2015.10); *A63B 22/0087* (2013.01);
(Continued)

(58) Field of Classification Search
CPC .. A63B 22/0076–0087; A63B 21/4034; A63B 21/4015; A63B 21/4035;
(Continued)

(56) References Cited

U.S. PATENT DOCUMENTS 1,975,021 A * 9/1934 Schmidt ..... A63B 22/0076 482/72
3,837,642 A * 9/1974 Martin ..... A63B 21/068 482/38

(Continued)

FOREIGN PATENT DOCUMENTS

CN 2902357 Y 5/2007
EP 1161970 A1 12/2001

OTHER PUBLICATIONS

International Search Report and Written Opinion for PCT/US2020/021512 dated Jul. 20, 2020.

*Primary Examiner* — Jennifer Robertson
*Assistant Examiner* — Catrina A Letterman
(74) *Attorney, Agent, or Firm* — Dorsey & Whitney LLP

(57) ABSTRACT

A foot support assembly for an exercise machine may be configured for sing-hand operation (e.g., cinching or releasing of the foot strap). The foot support assembly may include a footplate coupled to the frame of the exercise machine and configured to support the user's foot during exercise and a strap coupled to the footplate and configured to resist separation of the user's foot from the footplate. The strap is operatively associated with a quick release ratchet mechanism, which is configured to be unlocked simply by pressing a lever of the ratchet to allow the ratchet strip to reverse, releasing the user's foot from the strap. The foot support assembly may be provided on each side of the seat rail of a rowing machine, which may alternatively or additionally include a multi-grip handle including a plurality of grip portions configured to position the user's hand at different orientations to one another.

20 Claims, 11 Drawing Sheets

(51) Int. Cl.

| | |
|---|---|
| ***A63B 69/00*** | (2006.01) |
| *A63B 21/008* | (2006.01) |
| *A63B 21/22* | (2006.01) |
| *A63B 24/00* | (2006.01) |
| *A63B 71/06* | (2006.01) |

(52) U.S. Cl.
CPC ..... *A63B 69/0057* (2013.01); *A63B 21/008* (2013.01); *A63B 21/00069* (2013.01); *A63B 21/00192* (2013.01); *A63B 21/225* (2013.01); *A63B 24/0087* (2013.01); *A63B 71/0622* (2013.01); *A63B 2071/0625* (2013.01); *A63B 2225/09* (2013.01); *A63B 2225/093* (2013.01); *A63B 2225/50* (2013.01)

(58) Field of Classification Search
CPC ..... A63B 23/03525; A63B 21/4033–4034; A63B 22/0048; A63B 22/0605–0652; A44B 11/00–28; B62M 1/18; B62M 3/08; B62M 3/086; B62M 3/10; B62M 3/083; B62J 25/04; B62J 25/06
USPC ..... 74/560
See application file for complete search history.

(56) References Cited

U.S. PATENT DOCUMENTS

| | | | | |
|---|---|---|---|---|
| 4,846,461 | A * | 7/1989 | Robards, Jr. ..... | A63B 22/0076 482/72 |
| 5,707,322 | A * | 1/1998 | Dreissigacker ..... | A63B 21/227 482/72 |
| 5,745,963 | A * | 5/1998 | Graziano ..... | A43B 1/0072 24/68 SK |
| 6,231,485 | B1 * | 5/2001 | Dreissigacker ..... | A63B 21/227 482/57 |
| 6,371,892 | B1 * | 4/2002 | Dreissigacker ..... | A63B 21/227 482/72 |
| 8,337,369 | B1 | 12/2012 | Jacobson | |
| 9,375,604 | B2 * | 6/2016 | Yeh ..... | A63B 22/0046 |
| 9,770,073 | B2 * | 9/2017 | Ryou ..... | A44B 11/16 |
| 10,426,994 | B1 * | 10/2019 | Campanaro ..... | A63B 21/4035 |
| 2005/0070404 | A1 | 3/2005 | Ching | |
| 2015/0190673 | A1 | 7/2015 | Robinson et al. | |
| 2018/0339189 | A1 | 11/2018 | Luger et al. | |

* cited by examiner

FOOT SUPPORTS WITH FIT ENHANCEMENT FEATURES FOR AN EXERCISE MACHINE

BACKGROUND

A variety of exercise apparatuses (including stationary and non-stationary exercise machines) are in ubiquitous use today for maintain health and fitness. For example, an indoor rower, or rowing machine, is a machine used to simulate the action of watercraft rowing for the purpose of exercise or training for rowing. Other types of exercise machines include stationary and no-stationary bicycles, elliptical machines, and others. Many exercise machines include one or more handlebars, which are designed to be gripped by the user, e.g., for support such as on a bicycle, or for operating the exercise machine such as by applying a force against a resistance assembly of the exercise machine. Some exercise machines may additionally or alternatively include foot supports, which in some cases may be equipped with devices for adjusting the fit of the foot supports. Designers and manufacturers of exercise machines continue to seek improvements thereto, e.g., for enhancing the user experience.

SUMMARY

A foot support assembly for an exercise machine according to the present disclosure may include a footplate coupled to a frame of the exercise machine, a strap coupled to the footplate, the strap and footplate collectively defining an opening for receiving a user's foot, and a lock member operatively coupled to the strap, whereby pressing the lock member decouples the lock member from the strap to enable enlargement of the opening.

In one example, the lock member includes a pawl and is part of a ratchet mechanism (or simply ratchet), which further includes a rack (or ratchet strip), and a mount for operably (e.g., pivotally or otherwise movably) mounting the pawl to the rack. The pawl selectively engages the rack to resist movement of the strap in one direction while allowing movement of the strap in the opposite direction. The pawl is biased toward the rack, and pressing the lock member applies a force against the biasing force on the pawl.

In some examples, the ratchet mechanism may include a housing that encloses at least a portion of the rack, the lock member, or both. The housing may thus provide the mount for the pawl. The housing may be configured to route a free end of the strap toward the user when the user is positioned to use the exercise machine (e.g., when seated on the seat of a rowing machine), and a pull member may be provided on the free end of the strap facing the user, which may further enhance the single-hand operation of the mechanism and thus enhance the user experience. The foot support assembly may also include an adjustable heel cup, enabling further adjustments to the fit of the foot support assembly.

In yet further examples, the exercise machine, for example a rowing machine, may include a multi-grip handle. The multi-grip handle may include a plurality of grip portions for each of the user's left and right hands, each of which is configured to arrange the user's hands in different position and/or orientation to the midline and/or relative to one another. In one example, the multi-grip handle may include a first pair of grip portions (i.e., left and right grip portions) that position the user's hands such that they generally face one another. The first left and right grip portions may be located at the later ends of the handle and may thus be referred to as outer-most grip portions of the multi-grip handle. Other grip portions of the multi-grip handle may position the user's hands at different locations along the length and generally in line with the longitudinal direction of the handle. The handle may include additional fit enhancement features such as a curved middle portion, with the apex pointing toward the front of the rowing machine, which provides a torso relief area.

In accordance with some examples herein, a foot support assembly for an exercise machine may include a footplate configured to be coupled to a frame of the exercise machine for supporting a user's foot during exercise, a strap coupled to the footplate and configured to resist separation of the user's foot from the footplate, the strap defining an opening for receiving the user's foot, and a fit adjustment mechanism operatively coupled to the strap for adjusting a size of the opening, wherein the fit adjustment mechanism is configured for single-hand operation whereby pressing a lever of the fit adjustment mechanism unlocks the fit adjustment mechanism enabling enlargement of the opening. The fit adjustment mechanism may include a ratchet operatively associated with the strap, the ratchet including a pawl fixed to the lever and biased toward engagement with the strap. The foot support assembly may further include a foot-arresting component configured to resist movement of the user's foot along the length of the footplate. In some embodiments, the foot-arresting component may be configured to resist movement of the user's foot length-wise along the footplate, and it may be movably coupled to the footplate to enable adjustment of a size of a foot receiving area defined collectively by the footplate, the strap, and the foot-arresting component.

A rowing machine according to the present disclosure may include a frame including a base for contact with a support surface and a seat rail supported by the base, a seat configured to reciprocate back and forth along the seat rail, a resistance mechanism supported by the frame, a handle operatively coupled to the resistance mechanism, and a foot support assembly. In some example, the foot support assembly may be implemented in accordance with any of the examples herein. In some example, the handle may be implemented as a multi grip handle in accordance with any of the examples herein. The various examples of fit adjustment features described herein may be used in any suitable combination to enhance an exercise machine of variety of different types, as will be appreciated in view of the detailed description of examples below.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Described herein are embodiments of fit enhancement features for components of an exercise apparatus, such as a rower. While examples herein are described with reference to a rowing machine, the principles of the present invention may be used with similar components of other types of exercise machines.

A typical rowing machine includes a resistance mechanism typically connected via a chain or belt to a handle bar, also referred to as pull bar or simply bar. The rowing machine includes a seat, which moves back and forth along a rail as the user pulls the bar aft against the resistance of the resistance mechanism. The rowing machine also includes a foot support assembly configured for supporting and stabilizing the user's feet as the user slides back supported on the seat while pulling the bar aft.

Figure 1:
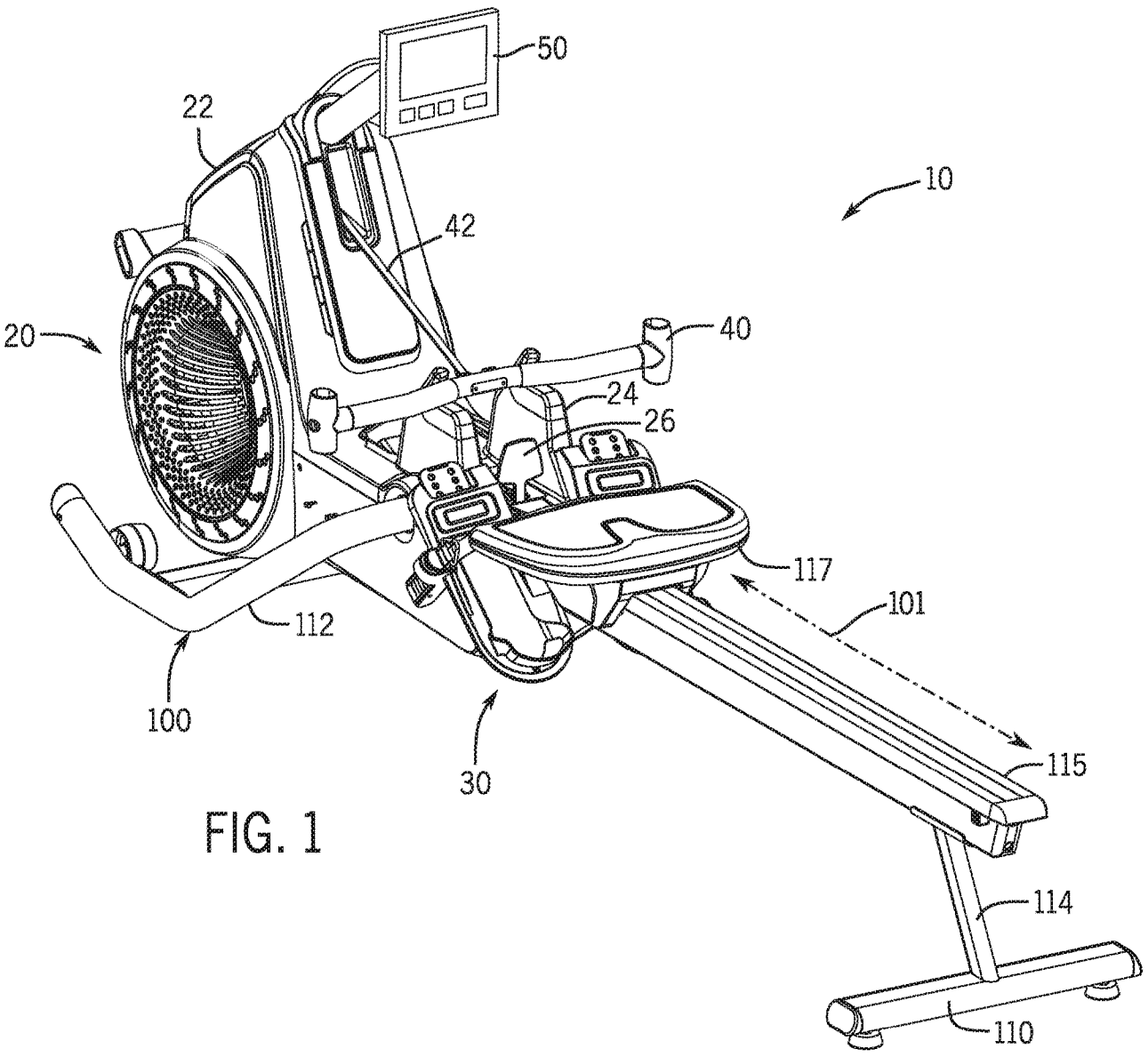
FIG. 1 is an isometric view of a rowing machine including foot supports and a handlebar in accordance with the present disclosure.
Figure 2:
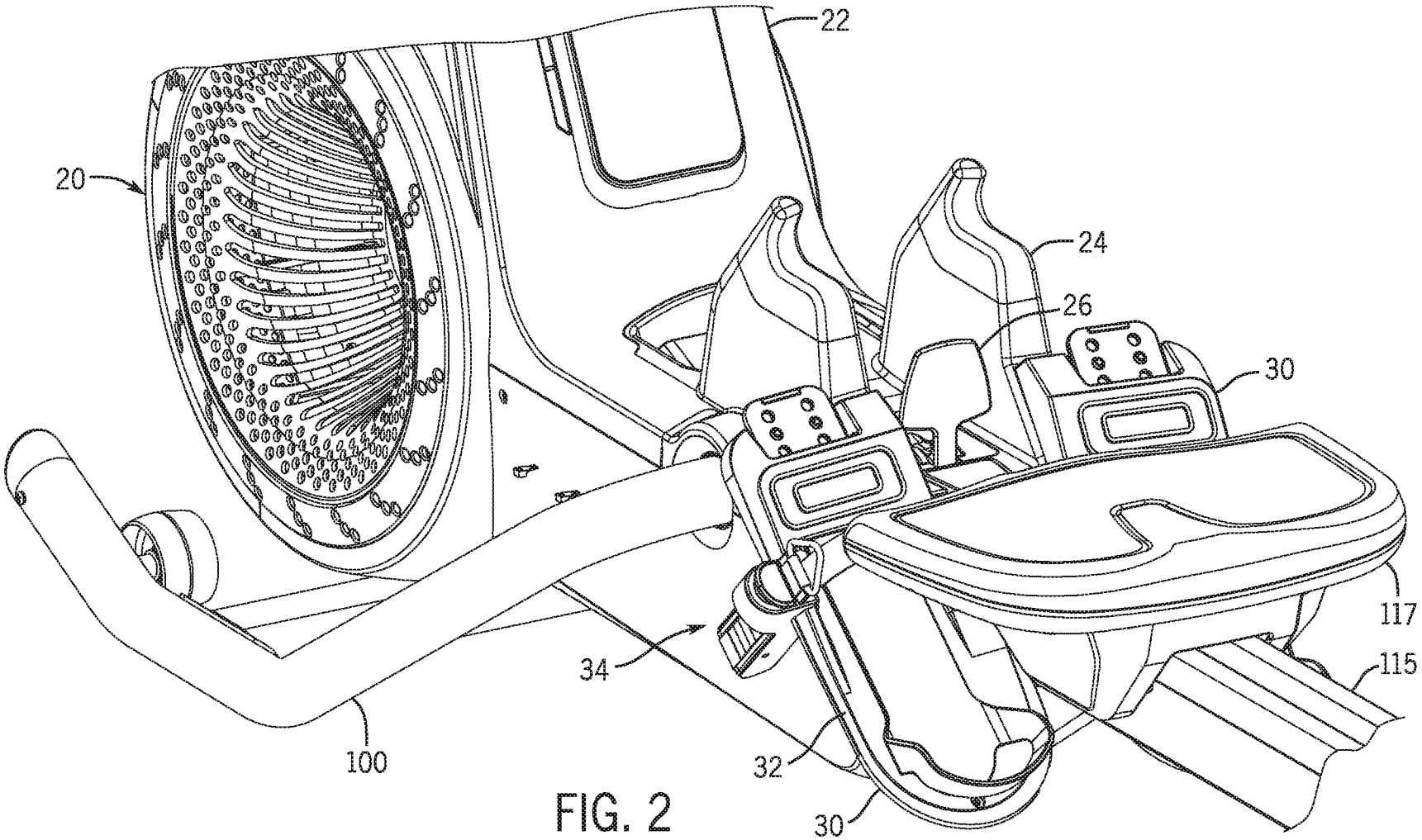
FIG. 2 is an enlarged view of the portion of the rowing machine in FIG. 1 that includes the foot supports.

Referring to the example in FIGS. 1 and 2, the rowing machine 10 includes a frame 100, a rowing engine 20, and a seat 117, which translates back and forth with respect to the forward end of the machine 10 during use of the machine 10. The rowing engine 20 in this example is positioned at the forward end of the machine 10. However, it will be appreciated that in other examples, the rowing engine 20 may be located elsewhere, such as at the rear end of the machine. The frame 100 includes a base 110, in this case a front and rear base supports, for contact with a support surface (e.g., the ground) and first and second upright supports 112 and 114, respectively, which support a forward portion and an aft portion, respectively, of the rowing machine above the support surface. The frame 100 includes a seat rail 115 extending rearwardly from the first upright support 112. In some examples, the seat rail 115 may be fixed relative to the ground, such as by being fixed relative to the base. In some embodiments, the frame 100 may be configured to allow the user to adjust the angle of inclination of the rail 115 with respect to the ground, such as by varying the relative height of a forward and a rear portion of the seat rail 115. This may be achieved, for example by adjusting the height and/or angle of one of the upright supports (e.g., the second upright support) relative to the rail and/or base. An adjustment to the angle of inclination of the rail with respect to the ground may allow the user to tailor the exercise to suit their need, such as by increasing the leg muscle involvement by increasing the height of the rear end of the rail). In some examples, the seat rail angle with respect to ground may be varied from 0 degrees (i.e. level with ground) to up to about 15 degrees, or up to about 10 degrees, or up to about 6 degrees. In some examples, the incline may be fixed any angle within the range of 0 to about 15 degrees. As the incline increases the amount of force needed for the pull stroke increases thus increasing the difficulty of the workout. An incline-adjustable seat rail thus provides an additional adjustment point (additional to varying the resistance, for example) for vary the difficulty of the workout.

The seat rail 115 is configured to movably support the seat 117 to allow the seat to reciprocate back and forth (as shown by arrow 101) along the seat rail 115 during use of the machine. In some example, the seat 117 may be slidably supported on the seat rail 115 by one or more rollers (not shown) or other suitable sliding assembly positioned between the seat 117 and the rail 115. The rowing engine 20 may include one or more resistance mechanism configured to resist the pulling action by the user, such as a flywheel with a magnetic brake, a fan, a water-based resistance mechanism, or any other suitable resistance mechanism or a combination thereof. The one or more resistance mechanisms may be operatively coupled to a pull bar or handle 40 (e.g., via a belt 42 or a chain). In some embodiments, the one or more resistance mechanisms may be operatively coupled to the handle 40 via a transmission assembly, which in some cases may include gearing components configured to tailor the balance between torque and speed, such as by modifying the relative rotational speed between input and output. In some embodiments, the arrangement of the resistance mechanism(s) and/or transmission components of the rowing engine 20 may be implemented using the examples in U.S. Ser. No. 15/606,754, titled "Exercise Machine", the description of which is incorporated herein by reference in its entirety for any purpose.

Some or all of the components of the rowing engine 20 may be enclosed in a housing 22, e.g., to prevent accidental interference with moving components of the machine and/or for aesthetics. In some embodiments, the frame 100 and/or housing 22 of the machine 10 may include a handle support 24, which is configured to position and support the handle 40, when not in use, at a partly extended location, e.g., so that the handle 40 is more conveniently located to a seated user. The handle support 24 may include one or a plurality of hooks or other suitable structures configured to hold the handle 40 in a partially extended position, e.g., against the cable return mechanism of the rowing engine 20. As shown in the example in FIG. 2, the handle support 24 may be implemented using a pair of hooks, each on opposite side of the rail 115.

The exercise machine 10 may include a user interface 50, which may be operatively coupled to the frame 100 such that the user interface is provided at a location that is accessible (e.g. the user can reach and operate the interface 50 while seated) or least visible to the user when exercising without interfering with the operation of the machine 10. The user interface 50 may include hard and/or soft controls for controlling functions of the machine 10 (such as controls for varying the resistance, for controlling functionality associated with tracking exercise performance or metrics, for controlling volume of an interface equipped with audio such as for entertainment or audible instructions to the user, and other controls). In some embodiments, components of the machine, such as resistance and/or braking force applied by the resistance mechanism, may be controllable via the user interface 50, via a mechanical component (e.g., lever 26), or a combination thereof. In some examples, the machine 10 may be equipped with a communication link component(s) (e.g., a W-Fi interface) for communicatively coupling to a mobile computing device (e.g. a mobile phone, or other smart or media device of the user). The machine 10 may include a media holder configured to support the mobile computing device and may, in some such examples, be configured to communicate one or more of the user interface elements (e.g., soft controls) for controlling functions of the machine 10 (such as controls for volume, resistance, and or performance tracking controls or feedback/display elements) to the mobile computing device, such that the user can operate the associated function via inputs to the mobile computing device, As shown in FIG. 2, the rowing machine 10 may include first and second foot support assemblies 30, each configured to support a respective one of the user's feet during exercise. The foot support assembly 30 may include foot support platform 32, which is angled to the rail 115. In some embodiments, the foot support platform 32 may be coupled to the frame 100 (e.g., by a mounting bracket rigidly connected to the frame) such that the angle to the rail 115 remains fixed at all times. In other examples, the foot support platforms may be adjustably coupled to the frame (e.g., to allow the user to adjust the angle to the rail before beginning exercise), resiliently coupled to the frame (e.g., to allow the foot support platform to temporarily and resiliently deflect, allowing for a slight change in angle during exercise), or both. The foot support assembly 30 may include a fit adjustment assembly 34 in accordance with the principles of the present invention. The fit adjustment assembly 34 may be configured for single-hand operation, which may improve the user experience. Foot supports of conventional exercise machines are often equipped with buckles for adjusting the strap around the user's foot, which typically require the user to use both hands to secure and release each foot to the machine. In accordance with the principles of the present disclosure, the fit adjustment assembly 34 may be configured to be unlocked for enlargement of the foot opening simply by pressing a button or lever, thus only requiring one hand for release of the user's foot off the foot support, To that end, the fit adjustment assembly 34 may include a lock member, which engages the strap and the lever may be operatively associated with (e.g., fixed to) the lock member to disengage it from the strap responsive to actuation of the lever. The lock member may be biased toward engagement with the strap such that pressing the lever, acting against the biasing of the lock member, causes the lock member to disengage from the strap thereby allowing the foot opening to be enlarged simply by the user pulling against the strap with his or her foot, without requiring use of both hands. Additionally, the fit adjustment assembly 34 may be configured for adjustment in the opposite direction (e.g., tightening or cinching) also by a single hand operation. For example, and as described further below, the fit adjustment assembly 34 may employ a ratchet mechanism to enable a single-handed tightening of the strap, such as by applying a pulling force to a free end of the strap in a direction away from the foot support platform 32.

FIGS. 3-6 show views of a foot support assembly 300 in accordance with examples of the present disclosure. The foot support assembly 300 may be used to implement the foot support assembly 30 of the rowing machine 10 in FIG. 1 or a foot support assembly of a different type of exercise machine. The foot support assembly 300 includes a foot support platform 310 and a fit adjustment system 340. The components of the foot support assembly 300 and arrangement thereof in FIGS. 3-6 are provided for illustrating the principles of the present invention and variations, such as replacing, removing, of combining features, may be used in other examples.

Figure 3A:
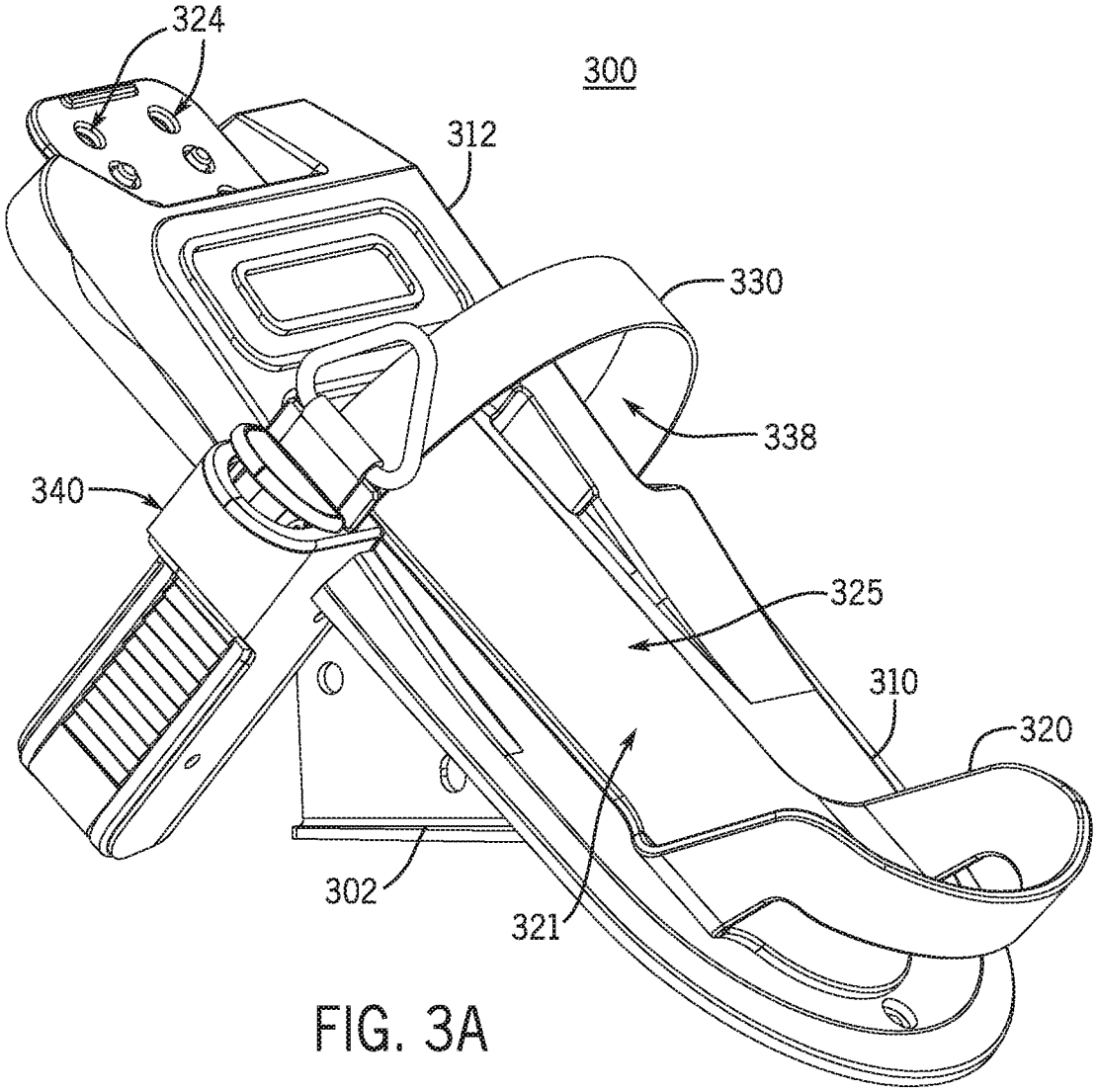
FIG. 3A is a view of a foot support assembly in accordance with examples of the present disclosure.
Figure 3B:
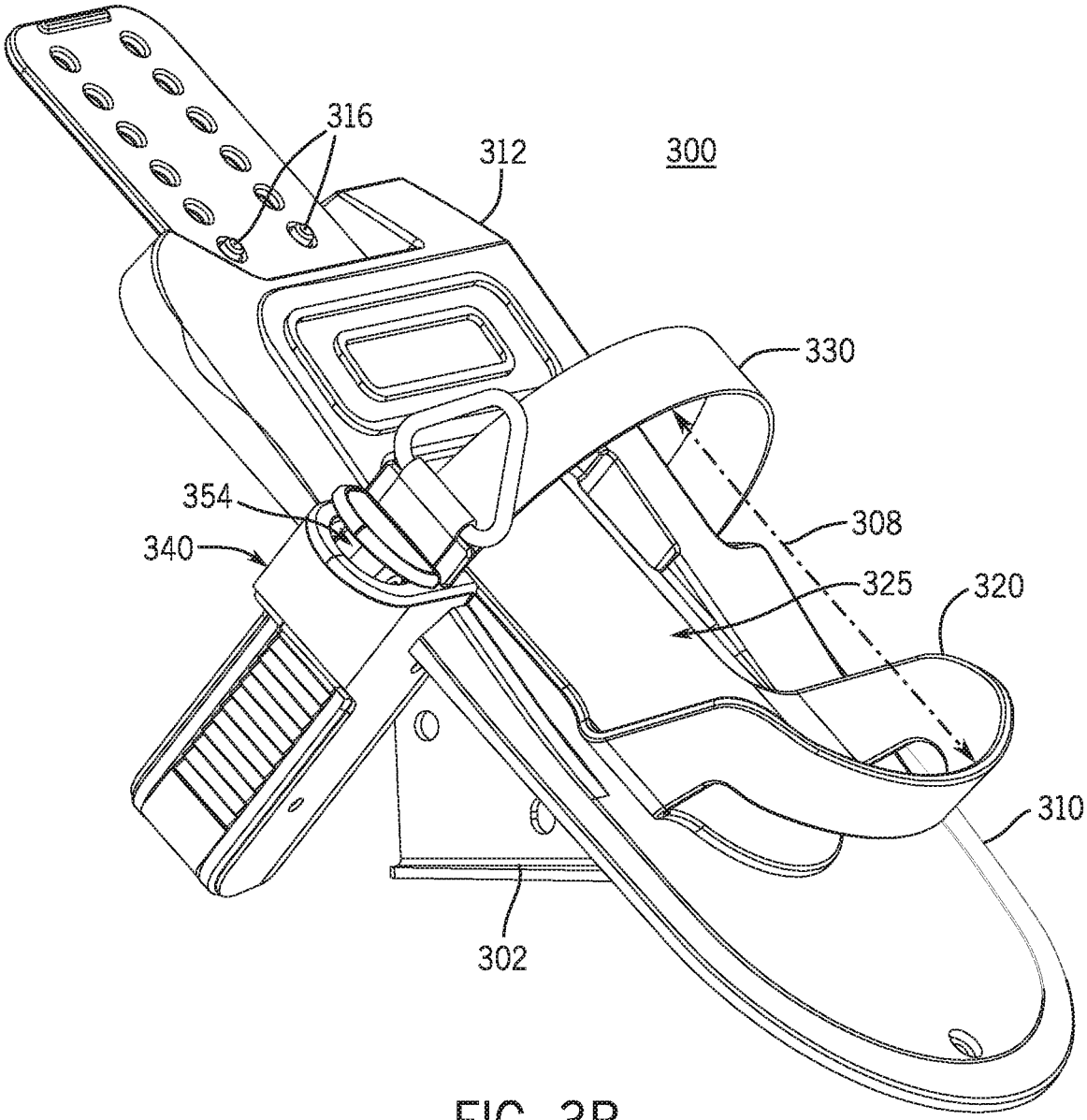
FIG. 3B is another view of the foot support assembly in FIG. 3A with a portion thereof adjusted for fit.

As shown in FIGS. 3A and 3B, the foot support platform 310 includes a footplate 302 operatively associated with a foot-arresting component 320 and a foot-cinching component 330. The footplate 302 is configured to support the user's foot during exercise. For example, specifically in the case of a rowing machine, the footplate 302 may be arranged to provide a suitable structure, e.g., ergonomically arranged on the frame, to allow the user to push off with his or her legs during the power or drive phase of the rowing stroke. Referring also to the exploded view in FIG. 4, the footplate 302 may be mounted, in this example rigidly mounted, to the frame via a foot support mount (e.g., bracket 306). The bracket 306 is configured to mount the footplate 302 at an angle to the rail 115 (e.g., at an angle ranging from 5 degrees to 55 degrees). In some examples, the footplate 302 may be adjustably and/or resiliently mounted to the rail 115.

The foot-arresting component 320 is configured to engage the user's foot to resist movement of the user's foot in at least one direction (e.g., along the length of the footplate 302). In the present example, the foot-arresting component 320 is configured to engage a rear portion of the user's foot to prevent the foot from sliding off the rear end of the footplate 302, and thus off the foot support platform 310, such as when the foot support platform 310 is positively inclined to horizontal (i.e. with the toe end of the footplate 302 pointing upward). The foot-arresting component 320 may thus include a heel cup 322, which is configured to at least partially encircle the heel of the user's foot. In other examples, such as when the fit adjustment system is used with a different type of exercise machine (e.g., a bicycle) where the foot support platform is fixed at or passes through a position negatively inclined to horizontal, the foot-arresting component may be configured to engage a front portion of the user's foot to resist the foot from sliding toward the front end of the footplate. Thus, in some examples, the foot-arresting component may include a toe clip, a toe cage, or any other suitable structure, configured to abut and/or surround the user's toes or otherwise prevent the user's foot from sliding off the foot support.

In some examples, the foot-arresting component 320 may be movably coupled to the footplate 302 for adjusting the size of a foot receiving area 321 of the foot support assembly 300. For example, as shown in FIGS. 3A-3B, the heel cup 322 may be movably coupled to the footplate 302 for adjusting the distance 308 between the heel cup 322 and the strap 330. In the example in FIG. 3, the foot support assembly 300 includes a footplate cover 312, which is positioned over the footplate 302 and coupled thereto (e.g., rigidly coupled using mechanical fastener(s) or other suitable means). The footplate cover 312 may be substantially co-extensive with the footplate 302, and may include traction features 313 configured to increase the traction between the user's foot and the foot support platform 310, thereby further resisting movement of the user's foot relative thereto. The traction features 313 may, in other examples, be directly applied to the footplate 302. In the example in FIGS. 3A-3B, the footplate cover 312 defines a slot 314 configured to movably, and in some examples removably, receive the foot-arresting component 320. The slot 314 may be sized to allow the upper, generally planar portion 325 to slide through the slot. The heel cup 322 may thus be slidably coupled to the footplate 302 via the slot 314 to allow for an adjustment of the size of foot receiving area 321.

Figure 4:
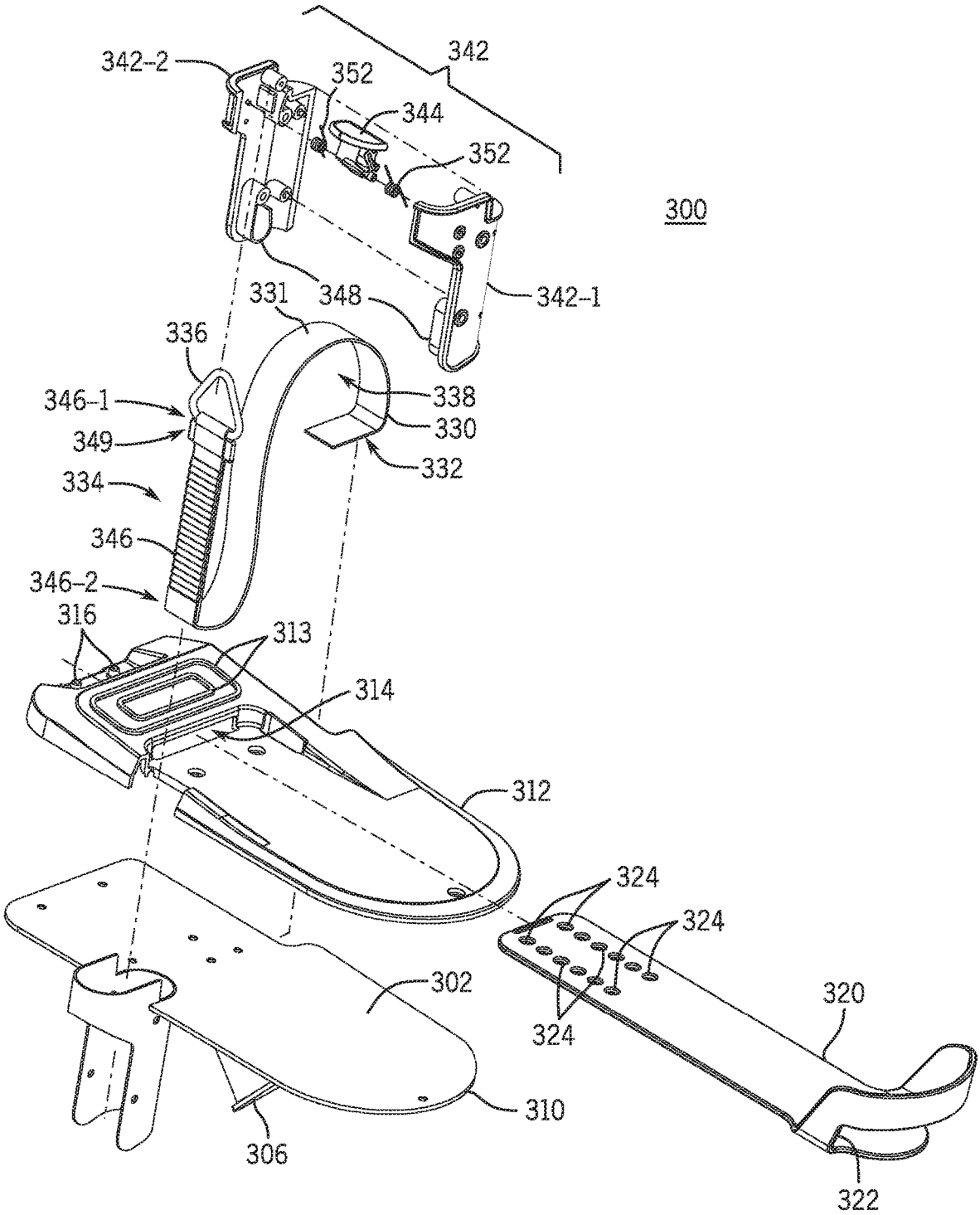
FIG. 4 is an exploded view of the foot support assembly in FIG. 3A.

The movable, and in some cases removable, foot-arresting component 320 may be configured to attach to the foot support platform 310 at any one of a plurality of positions (discrete or continuously selectable through an adjustment range). In the present example, the foot-arresting component 320 is attachable to the foot support platform 310, and thus adjustable to any one of a plurality of predetermined sizing positions. As shown in FIGS. 3-4, the heel cup 322 includes a rounded portion configured to at least partially encircle the user's heel. The rounded portion may be fixed to or integrally formed with the generally planar portion 325, which is received in the slot 314. The portion 325 may be implemented using any suitable structure configured to attach to the foot support platform so as to operatively couple the heel cup 322 to the footplate 302. For example, the portion 325 may define a plurality of positioning holes 324, in this example pairs of positioning holes 324. Each of the positioning holes 324 is located at a predetermined distance away from the apex of the rounded portion of the heel cup 322 and is configured to engage a corresponding pair of locator features 316 on the foot support platform, each of which is associated with one of the plurality of predetermined sizing positions. In other examples, a different attachment mechanism for securing the movable heel cup 322 to the footplate 302 may be used.

The foot-cinching component 330 may be implemented by a strap 331 operatively associated with the foot support platform 310 to engage the user's foot to resist separation of the user's foot from the foot support platform. The strap 331 may be woven from natural and/or synthetic fibers or it may be made of a suitable (e.g., bendable but substantially non-elastic in the longitudinal dimension), plastic material such as nylon, or other type of suitable material. One end 332 of the strap 331 may be fixed to the foot support platform 310 e.g., by being glued, fastened, or otherwise rigidly connected to the footplate 302, the footplate cover 312, or any other component of the foot support platform 310, or combinations thereof, The opposite end of the strap 330, also referred to as the free end 334, may be operatively associated with a fit adjustment mechanism, in this example with a ratchet mechanism 341 configured for single hand operation. The strap 331 includes a first side 331-1, which faces the foot support platform 310 and which defines the foot opening 338, and a second side 331-2 opposite the first side 331-1.

In some examples, the fit adjustment mechanism may be implemented as a quick release ratchet mechanism 341. The ratchet mechanism 341 includes a lock member 344 configured to engage a ratchet strip or rack 346 for locking the strap 331 into a desired size of the foot opening 338, The ratchet mechanism 341 may further include a ratchet housing 342, which provides a mount for the lock member 344, The ratchet housing 342 is fixed in relation to the footplate 302, in some examples rigidly mounted directly to the foot support platform (e.g., to the footplate). The ratchet housing 342 may at least partially enclose one or more components of the ratchet mechanism 341.

Figure 5:
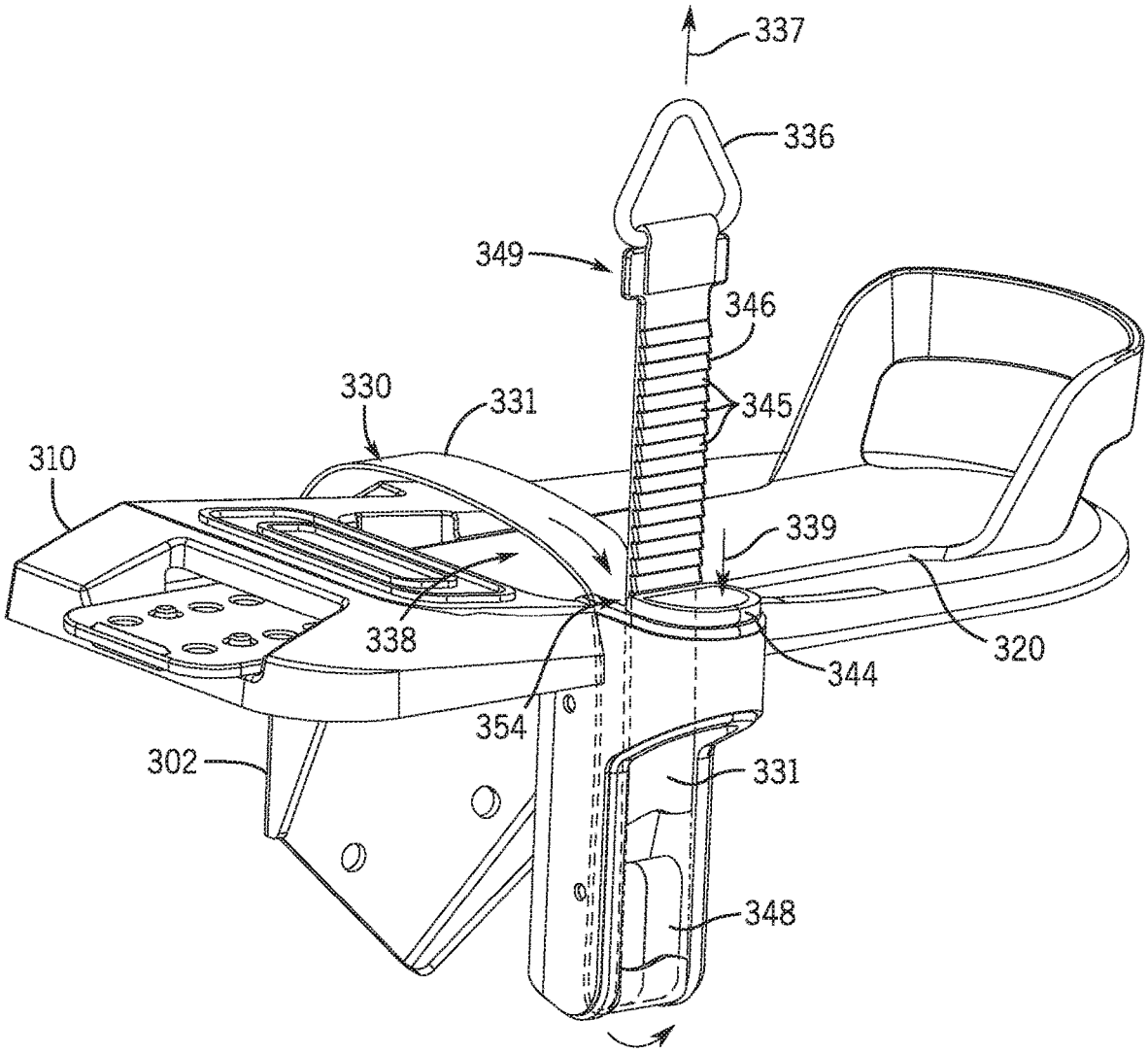
FIG. 5 is another view of the foot support assembly of FIG. 3A illustrating the operation of a fit adjustment assembly in accordance with the present disclosure.
Figure 6A:
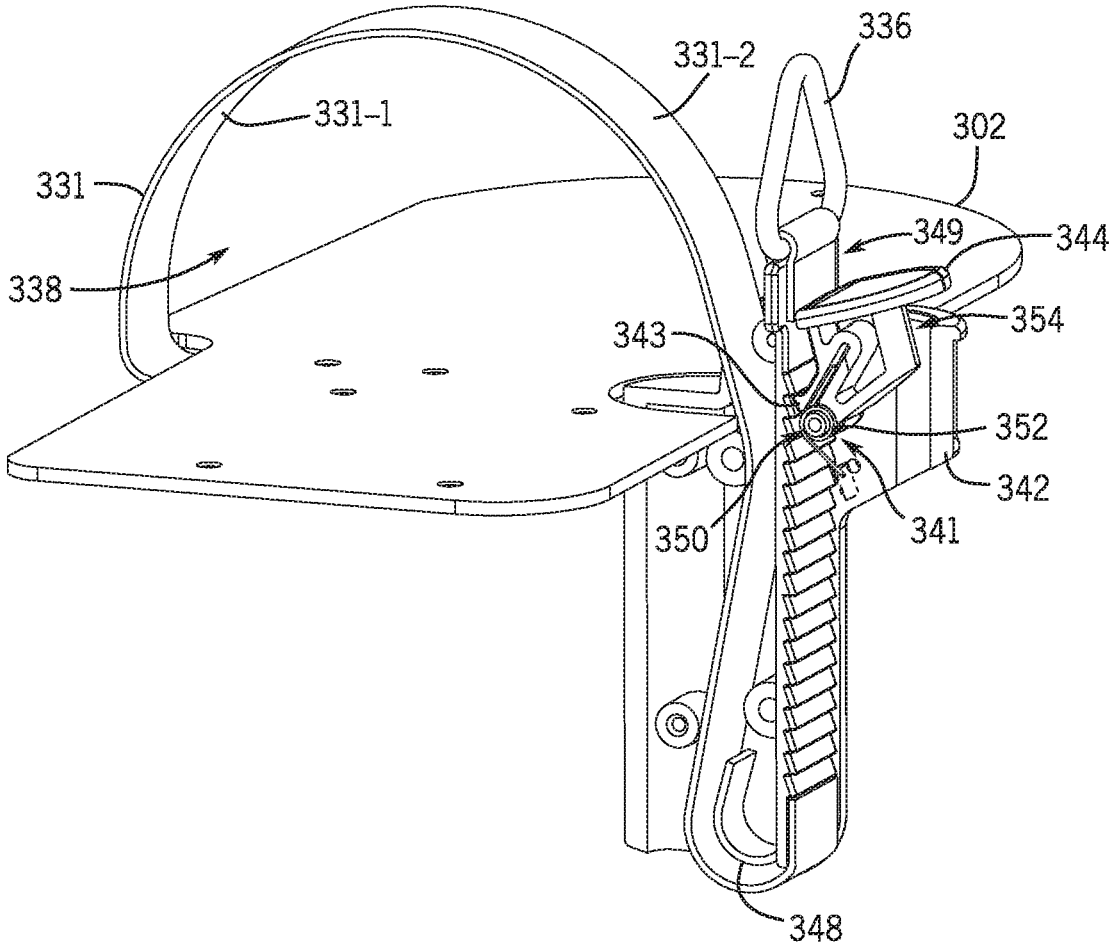
FIG. 6A is a partial view of the foot support assembly of FIG. 3A with certain components removed to illustrate features of the fit adjustment assembly.
Figure 6B:
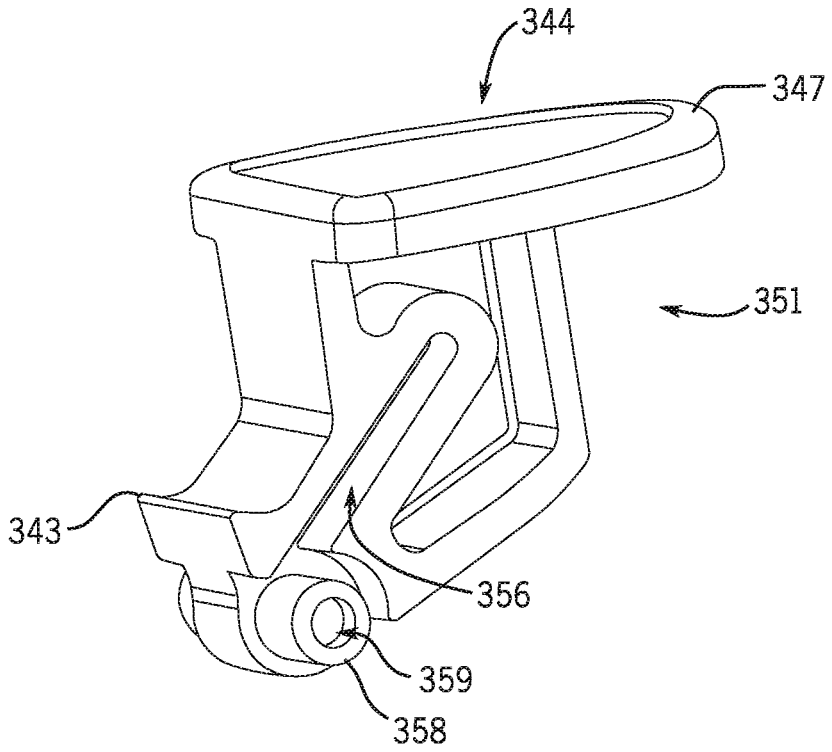
FIG. 6B is an isometric view of a lock member of a fit adjustment assembly in accordance with the present disclosure.

As shown e.g., in FIGS. 5 and 6A, the ratchet strip or rack 346 has a plurality of asymmetrical teeth 345 arranged to limit or prevent movement of the rack 346, when engaged with the lock member 344, in one direction, referred to as the release or enlargement direction. The teeth 345 are asymmetrical in that they are more shallowly inclined in the direction away from the free end 349 to allow movement of the rack 346 in a direction opposite the release direction (indicated by arrow 337 and referred to herein as the cinching or tightening direction), The rack 346 is rigidly coupled to (e.g., fixed to or integrally formed with) the free end 349 of the strap 331.

In some examples, the ratchet strip 346, which may be formed from a different material than the strap 331, may be attached to the end of the strap to function as an extension of the strap, or it may overlay a portion of the strap, thus being part of the free end 349 of the strap. As shown, e.g., in FIG. 5, the ratchet strip 346 may be coupled to the first side 331-1 of the strap 331 with the teeth 345 facing laterally outward from the foot support platform 310. The ratchet strip 346 may include a proximal end 346-1 (closest to the user during operation of the fit adjustment mechanism) and a distal end 346-2. The free end 349 may be equipped with a pull member 336, e.g., at the proximal end 346-1, for ease of application of a pulling force. The pull member 336 may be implemented using any suitable structure allowing the user to hook his or her finger(s) through or around the pull member 336 for applying the pull force. While the pull member 336 is illustrated as a pull loop in the present example, the pull member 336 may be implemented using a different suitable structure, such as a hook, a T-shaped member with the top of the T toward the user, a series of loops, hooks or T-shaped structures, or any combinations thereof.

The lock member 344 may be configured to selectively engage the strap 331 to resist movement of the free end 334 of the strap 330 in a direction resulting in enlargement of the foot opening 338, also referred to as release direction. In the present example, the lock member 344 includes a pawl 343, which is configured to engage the teeth 345 of the rack 346 of the ratchet mechanism 341 thereby preventing movement of the rack 346 in the release direction. The lock member 344 is biased toward engagement with the rack 346, thus in the absence of any manual force applied to the lock member 344, the lock member 344 prevents movement of the rack 346, and thus the strap 331, in the release direction. In the present example, the lock member 344 is biasingly pivotally mounted to the ratchet housing 342 via a pivot joint 350, such that the lock member 344 can pivot toward and away from engagement with the rack 346. In other examples, the lock member 344 may be slidably biased toward engagement with the rack 346, Referring also to FIG. 6B, a lock member 344 according to the present disclosure may be implemented as a monolithic component or body 351 (e.g., made of metal, plastic material, or other suitable material) that includes a ratchet engagement portion or pawl 343, an actuation portion or lever 347, and a pivot portion 358. The pivot portion 358 defines a pass-through opening 359 through which a pin is inserted to form the pivot joint 350. In the example in FIG. 6B, the locking member 344 is biased at the pivot such as by operatively coupling one or more biasing elements (e.g., one or more springs 352) between the lock member and the mount (e.g., the ratchet housing) at the location of the pivot. In this example, the biasing elements (e.g., springs 352 are operatively engaged with the pivot portion 358 via respective seats 356 (only one fully visible in the view in FIG. 6B). In the illustrated example, each seat 356 is implemented as a recess around and extending radially outward from the opening 359, however other suitable means for operatively coupling a biasing element with the lock member may be used in other examples.

The free end 349 with the rack 346 and pull member 336 is threaded through the ratchet housing 342 to position a pull member 336 at a location that is easily accessible to the user when seated, such as facing or pointing generally upward or towards the user. The ratchet housing defines an opening 354, through which the free end 349 of the strap 331 passes into the housing 342. The ratchet housing 342 further includes a strap deflector 348 spaced apart from the opening 354. In this example, a portion of the ratchet housing 342 including the strap deflector 348 is positioned below the footplate 302. The strap deflector 348 redirects the free end 349 of the strap 331 toward the opening 354 to orient the free end 349 of the strap 331 and thus the pull member 336 toward a location of the foot support assembly that may be easily accessible by the user (e.g., toward the top side of the foot support platform and pointing generally towards the user). The strap deflector 348, which may be implemented a transverse post, roller, or other suitable structure, is configured to transversely slidably engage the strap 331. The strap deflector 348 may be spaced apart from the entry and exit opening(s) of the ratchet housing (e.g., opening 354) by a sufficient distance such that the ratchet strip 346 remains substantially on the lateral side of the ratchet mechanism 341 during the full range of motion of the ratchet strip 346. For example, as shown in FIG. 6A, the distance may be substantially the same as the length of the ratchet strip 346, which may be selected based upon the desired range of movement of the ratchet strip 346. While the ratchet housing 342 of the present example is implemented using two ratchet housing halves (342-1 and 342-2) rigidly coupled to one another, in other examples, the ratchet housing may be differently formed, for example as an integral component.

With further reference to FIGS. 5 and 6A, during use, after placing a foot on the foot support platform 310 against the foot-arresting component 320, the user may simply pull the free end of the strap, e.g., via the pull member 336 in the direction 337 to tighten the strap 331. As the user pulls on the free end of the strap 331, the rack 346 advances out of the ratchet housing 342, with the pawl 343 traveling substantially uninhibited over the shallowly inclined sides of the teeth 345, clicking at each increment into engagement with the steep side of the tooth to prevent reverse movement of the rack 346. To release the foot, the user simply presses the lever 347 of the lock member 344, as indicated by arrow 339, which causes the lock member 344 to rotate about the pivot 350 causing the pawl 343 to pivot upward and away from the rack 346, unlocking or releasing the ratchet mechanism 341 for enlargement of the opening 338.

Figure 7:
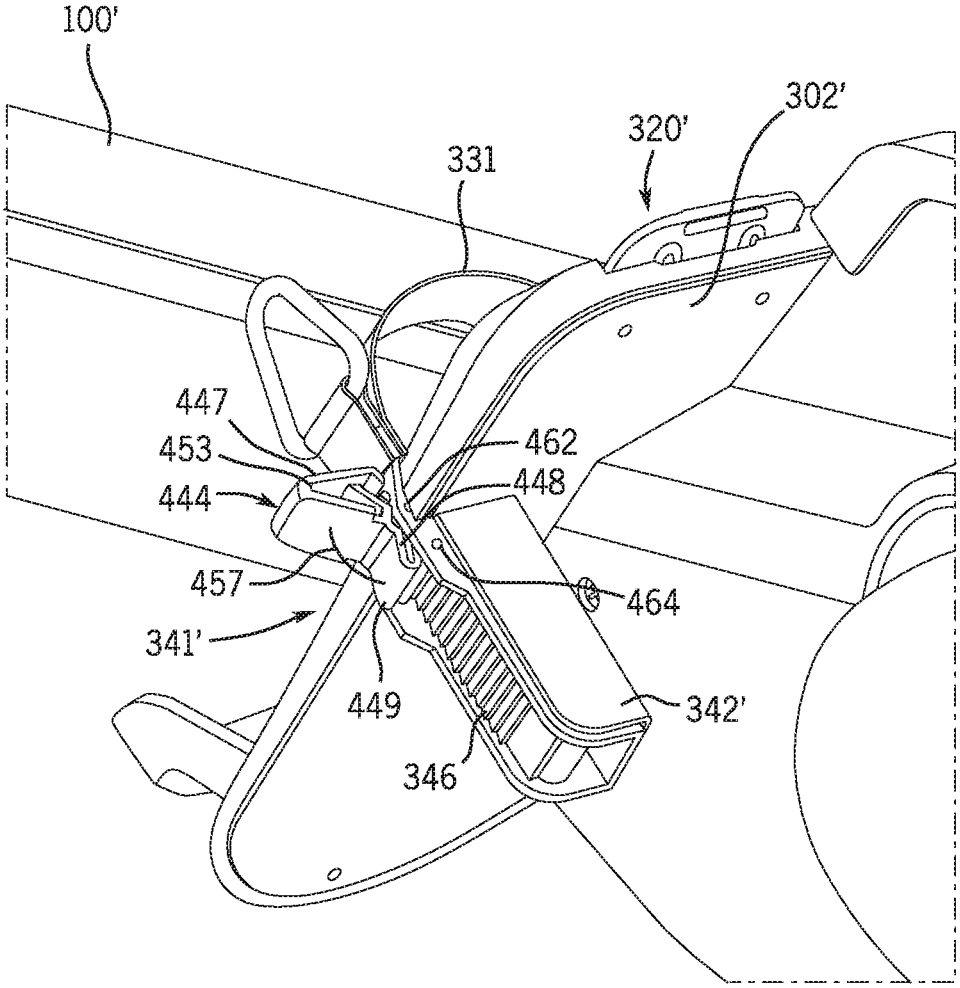
FIG. 7 is another view of a foot support assembly including a lock member in accordance with further examples of the present disclosure.
Figure 8:
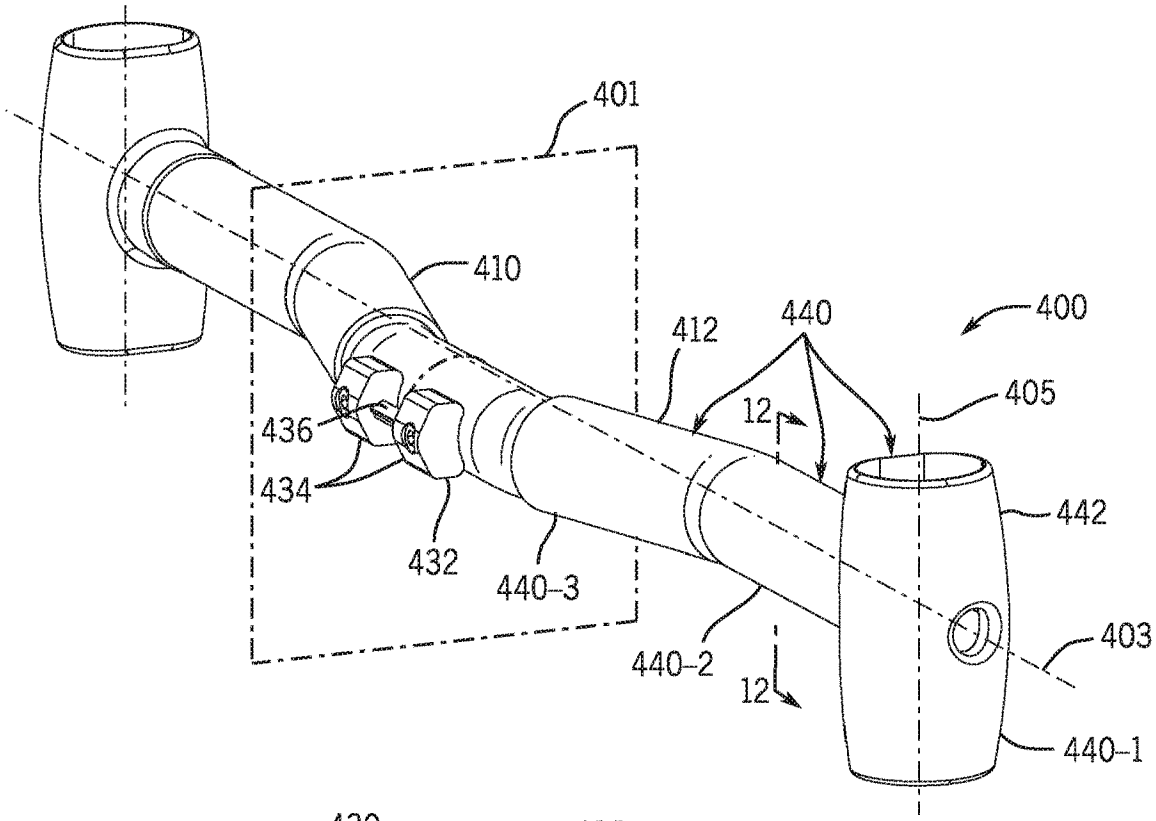
FIG. 8 is a view of a handle in accordance with examples of the present disclosure.

FIG. 7 shows a foot support assembly 320' according to further examples of the present disclosure. The foot support assembly 320' similarly includes a footplate 302' coupled to the frame 100' of an exercise machine, a strap 330 coupled to the footplate 302' for securing the user's foot thereto, and a ratchet mechanism 341' comprising a lock member 444. Similar to the lock member 344, the lock member 444 is biased toward engagement with the strap 330. In the example in FIG. 7, however, the spring or biasing element 448 of the ratchet mechanism 341' is integrally formed with the lever 447 of the lock member 444. The lock member 444 may include an upper portion 453, which includes the lever 447 and the pawl (not shown in this view). The upper portion 453 may be pivotally coupled to the ratchet housing 342' via a pivot joint 462. The lock member 444 may be fixed to the ratchet housing 342' at a fixed joint 464. The lock member 444 may include a lower portion 449, which is configured to resiliently or elastically deform during use to act as a biasing element or spring between the upper portion 453 and the fixed joint 464. In use, the application of a downward pressure on the lever 447 compresses the spring (i.e., deforming the lower portion 449 by decreasing the angle 457) and thus causing the upper portion 453 to pivot at the pivot joint 462 to disengage the pawl from the rack 346' of the ratchet mechanism.

FIGS. 8-12 show views of a multi-grip handle 400 in accordance with the principles of the present disclosure. The handle 400 may be used to implement the pull bar or handle 40 of the rowing machine 10 in FIG. 1 or the handle of a different type of exercise machine. The handle 400 includes a substantially tubular body 410 configured to provide a plurality of grip positions for a user when operating an exercise machine, such as the rower machine 10, The handle 400 may be configured to be gripped by both of the user's hands simultaneously when using the exercise machine. As such, the handle 400 may include a left hand portion 420-1 and a right hand portion 420-2, which are substantially symmetrically arranged about a transverse mid-plane 401 of the handle 400. The left hand portion 420-1 and the right hand portion 420-2 may be joined at the mid portion 430. Each of the left and right hand portions 420-1 and 420-2 provides multiple grip positions for the respective left or right hand of the user and may thus be interchangeably referred to as left hand and right hand multi-grip portions.

The mid portion 430 may be configured for coupling the handle 400 to one or more moving components of the exercise machine. For example, when used with a rower such as the rowing machine 10, the mid portion 430 may include a cable or belt coupling 432. The coupling 432 may be implemented by a pair of mounts 434 rigidly attached (e.g., monolithically formed or welded) to a rod 436. The mounts 434 are configured, when coupled to the body 410, to space the rod 436 apart from the body 410, and in this case from the front side of the body 410, by a distance that accommodates the passage of the belt (e.g., belt 42 or rowing machine 10) therebetween. The belt 42 may thus be routed around the rod 436 and secured to itself thereby securely coupling the handle 400 to the resistance assembly of the exercise machine. The coupling 432 may be implemented in any suitable manner that securely attaches the handle 400 to the belt. To enhance the strength of the connection of the mounts 434 to the tubular body 410, the fasteners securing the mounts 434 to the body 410 may pass through the body 410 and terminate in one or more plates 437 provided on the opposite side of the body 410 from the mounts 434.

As shown in FIGS. 8-12, each of the left and right hand portions 420-1 and 420-2 may include a plurality of grip portions 440, in this example a first grip portion 440-1, a second grip portion 440-2, and a third grip portion 440-3. Each of the grip portions 440 may be configured to position the user's hands at different distances from the mid-plane 401 and/or orient the user's grip at different orientation to the mid-plane 401 such that the user's hands are differently oriented to one another when changing from one pair of grip portions to another.

The first grip portions 440-1 may be configured to position the user's hand at the longitudinal ends the handle 400. The first grip portions 440-1 may be further configured to position the user's hand at an orientation in which the user's palms face substantially toward one another when the user is gripping the handle with both hands. That is, the left and right grip portions 440-1, in this example, position the left and right hands of the user such that they are oriented with the palms generally toward one another, when the user is properly gripping the first grip portions 440-1. The first grip portions 440-1 may be contoured to guide the placement of the user's hand in a grip orientation in which the palms are generally pointing inward toward the midline of the machine. As such, the first grip portions 440-1 may include a curved surface 443 on the respective lateral side of each grip portion 440-1, the curve being selected to correspond to the natural curvature of the palm side of the user's hand when partially closed.

In some examples, the first grip portions 440-1 may be implemented using upright tubular members 442, which due to contouring to match the inside of the user's hand when partially folded, may be asymmetrically shaped and/or asymmetrically positioned with respect to the centerline of the tubular body 410. As illustrated in the top plan view in FIG. 9, the tubular members 442 may have a medial side 441, which is relatively flatter than the lateral side 478 providing the contoured surface 443. Any suitable (e.g., ergonomic) shape or contour of the outward facing surfaces of the grip portions 410-1 may be used, which generally follow the natural curve of the user's hand and fingers when gripping the portion 410-1.

Figure 9:
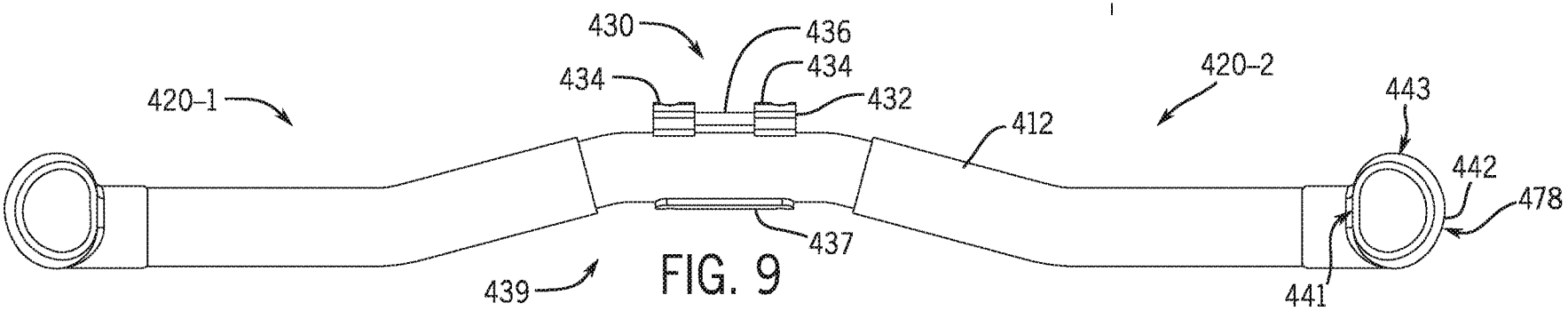
FIG. 9 is a top plan view of the handle in FIG. 8.
Figure 12:
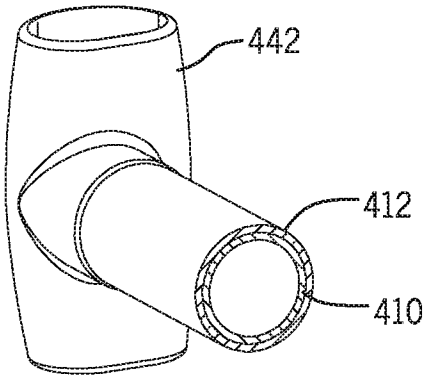
FIG. 12 is a cutaway view of the handle in FIG. 8, section at line 12-12 in FIG. 8.
Figure 10:
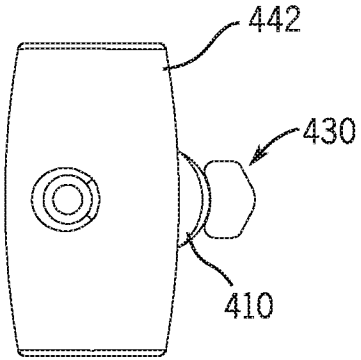
FIG. 10 is a side elevational view of the handle in FIG. 8
Figure 11:
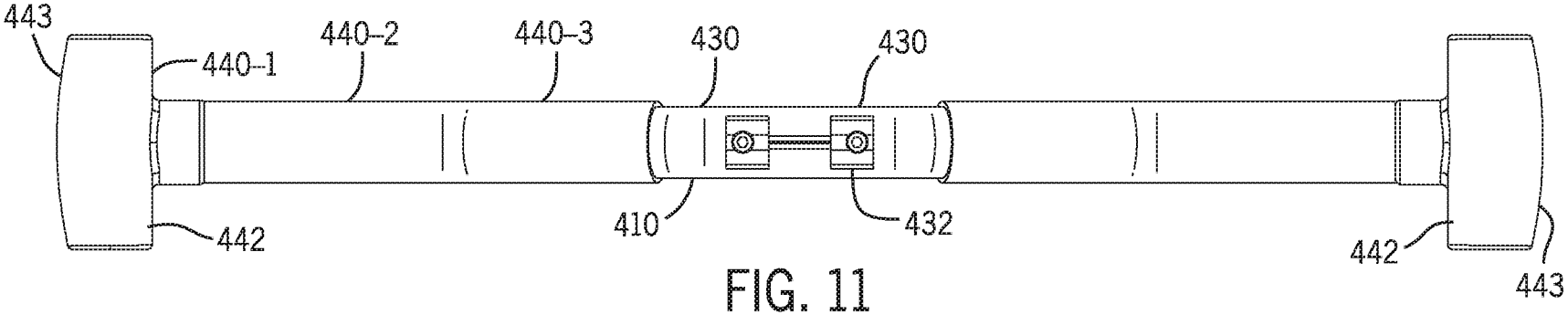
FIG. 11 is a front elevational view of the handle in FIG. 8.

The tubular members 442 may be oriented with the longitudinal axis 405 extending generally transversely to the longitudinal axis 403 of the body 410, in some examples, substantially perpendicularly thereto. As shown in the example of FIG. 9, the tubular member 442 may not be horizontally centered on the ends of the body 410 but may instead have a protruding forward portion, which can provide a more ergonomic placement of the user's hand, by the protruding forward portion providing a sufficiently large contoured surface to facilitate wrapping of the user's fingers around the member 442. The tubular members 442 may be joined to the body 410 via respective collars, which are configured to couple the tubular members 442 to the body in a manner, which offsets the tubular portions toward the front side of the handle 400. Other suitable shapes or placement of the grip portions 410-1 may be used, for example, the grip portions 410-1 (e.g., tubular members 442) may be provided with an undulating relief or surface feature configured to accommodate the user's fingers within valleys of the relief, As shown e.g., in FIGS. 8 and 9, the tubular member 442 may be hollow, which may reduce the overall weight of the handle 400 and thereby improve the user experience.

The pairs of second and third grip portions 440-2 and 440-3 may be configured to position the user's hands at two different longitudinal locations along the handle 410, which are progressive closer to the mid-plane 401, Both pairs of second and third grip portions may be configured to orient the user's hands to an orientation in which the user's palms are parallel to the pulling direction (e.g., palms up or palms down depending on the user's choice of overhand or underhand grip), Each pairs of second and third grip portions may be configured to position the user's hands at a different angle to the longitudinal axis 403. For example, the second grip portions 440-2 may position the user's grip generally in line with the axis 403, while the third grip portions 440-3 may position the user's grip at an angle to the axis 403, which in combination of the longitudinal distance from the mid-plane 401, may aid in activating different groups of muscles during exercise.

In some embodiments, as shown e.g., in FIG. 9, the handle body 410 may be contoured, e.g., at the mid portion 430, to define a torso relief area 439. The torso relief area 439 may be defined by shaping of the mid portion 430 to include a forward portion and angled side portion, which wrap around the user's torso for proper rowing form at the end of the stroke. The handle 400 may include a grip enhancement features, such as a coating or a sleeve 412 provided along some or the full length of the handle body 410 (e.g., along portions corresponding to the second grip portions 420-2, the third grip portions 420-3, or both) to increase the friction between the user's hands thereby improving the user experience.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Those skilled in the art will appreciate that the presently disclosed embodiments teach by way of example and not by limitation. Therefore, the matter contained in the above description or shown in the accompanying drawings should be interpreted as illustrative and not in a limiting sense.

What is claimed is:

1. A foot support assembly for an exercise machine, the foot support assembly comprising:

a footplate coupled to a frame of the exercise machine;

a strap coupled to the footplate, the strap and footplate collectively defining an opening for receiving a user's foot;

a lock member operatively coupled to the strap, whereby pressing the lock member decouples the lock member from the strap to enable enlargement of the opening; and a housing fixed to the footplate and having a length, a majority of which extends below the footplate, wherein the housing comprises a housing opening through which the strap enters the housing, wherein the lock member is pivotally coupled to the housing at a first longitudinal location of the housing proximate to the housing opening, and wherein the housing further includes a strap deflector positioned at an opposite longitudinal end of the housing spaced apart from and below the first longitudinal location, the strap deflector configured to route a free end of the strap back toward the housing opening.

2. The foot support assembly of claim 1, wherein the lock member is part of a ratchet mechanism comprising a rack fixed to the free end of the strap, wherein the lock member includes a pawl selectively engaging the rack to resist movement of the strap in a first direction while allowing movement of the strap in a second direction opposite the first direction while engaged with the rack.

3. The foot support assembly of claim 2, wherein the pawl is biased toward the rack by a spring, and wherein the lock member further comprises a lever whereby pressing the lever applies a force on the spring to disengage the pawl from the rack.

4. The foot support assembly of claim 3, wherein the spring is integrally formed with the pawl and the lever.

5. The foot support assembly of claim 3, wherein the lock member comprises a monolithic body including the pawl and the lever and a pivot portion joining the pawl and the lever, and wherein the spring is operatively engaged with the pivot portion to bias the lock member towards the strap.

6. The foot support assembly of claim 2, wherein the strap deflector is positioned below the footplate at a sufficient distance such that the rack remains on a lateral side of the housing during a full range of motion of the rack.

7. The foot support assembly of claim 1, further comprising a pull member fixed to a free end of the strap, wherein the pull member defines at least one opening for receiving at least one of the user's fingers.

8. The foot support assembly of claim 7, wherein the pull member comprises a loop.

9. The foot support assembly of claim 1, further comprising a heel cup coupled to the footplate.

10. The foot support assembly of claim 9, wherein the heel cup is movably coupled to the footplate such that a distance between the heel cup and the strap is adjustable.

11. The foot support assembly of claim 10 further comprising a footplate cover coupled to the footplate, and wherein the heel cup is slidably received in a slot defined by the footplate cover.

12. A rowing machine comprising the foot support assembly of claim 1, wherein:

the frame includes a base for contact with a support surface and a seat rail supported by the base; and wherein the rowing machine further comprises:

a seat configured to reciprocate back and forth along the seat rail;

a resistance mechanism supported by the frame;

a handle operatively coupled to the resistance mechanism; and wherein the foot support assembly is positioned on each of the left and right sides of the seat rail.

13. The rowing machine of claim 12, further comprising a handle support configured to hold the handle in a partially extended position.

14. The rowing machine of claim 12, wherein the handle comprises a plurality of left and right grip portions, each pair of left and right grip portions of the plurality configured to position the user's left and right hands at different orientations relative to one another.

15. The rowing machine of claim 14, wherein one pair of left and right grip portions of the plurality is configured to position the user's left and right hands in respective orientations in which the user's palms face one another.

16. The rowing machine of claim 12, wherein the handle comprises a handle body, and a pair of hollow upright tubular members arranged at opposite longitudinal ends of the handle body.

17. A foot support assembly for an exercise machine, the foot support assembly comprising:

a footplate configured to be coupled to a frame of the exercise machine for supporting a user's foot during exercise;

a strap coupled to the footplate and configured to resist separation of the user's foot from the footplate, the strap defining an opening for receiving the user's foot; and a fit adjustment mechanism operatively coupled to the strap for adjusting a size of the opening, wherein the fit adjustment mechanism comprises a monolithic body including an engagement portion configured to engage the strap to resist movement of the strap, a lever configured to actuate the engagement portion toward and away from the strap, and a spring that biases the engagement portion toward the strap, the fit adjustment mechanism being configured for single-hand operation whereby pressing the lever of the fit adjustment mechanism unlocks the fit adjustment mechanism enabling enlargement of the opening.

18. The foot support assembly of claim 17, wherein the engagement portion of the fit adjustment mechanism comprises a pawl, the foot support assembly further comprising a ratchet strip fixed to the strap and configured for engagement with the pawl to resist movement of the strap.

19. The foot support assembly of claim 18, further comprising a foot-arresting component configured to resist movement of the user's foot along the length of the footplate.

20. The foot support assembly of claim 19, wherein the foot-arresting component is configured to resist movement of the user's foot length-wise along the footplate, and wherein the foot-arresting component is movably coupled to the footplate to enable adjustment of a size of a foot receiving area defined collectively by the footplate, the strap, and the foot-arresting component.

* * * * *